US012680432B2

(12) United States Patent
Decker et al.

(10) Patent No.: US 12,680,432 B2
(45) Date of Patent: Jul. 14, 2026

(54) CONTINUOUS CARBON DIOXIDE INJECTION DURING ZIPPER HYDRAULIC FRACTURING OPERATIONS

(71) Applicant: ExxonMobil Technology and Engineering Company, Spring, TX (US)

(72) Inventors: Kendal K. Decker, Spring, TX (US); Xiao Jin, Kingwood, TX (US); Fuping Zhou, Sugar Land, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 0 days.

(21) Appl. No.: 19/072,227

(22) Filed: Mar. 6, 2025

(65) Prior Publication Data

US 2025/0297537 A1 Sep. 25, 2025

Related U.S. Application Data

(60) Provisional application No. 63/567,514, filed on Mar. 20, 2024.

(51) Int. Cl.

| | |
|---|---|
| ***E21B 43/14*** | (2006.01) |
| ***E21B 43/16*** | (2006.01) |
| ***E21B 43/267*** | (2006.01) |

(52) U.S. Cl.
CPC ..... *E21B 43/14* (2013.01); *E21B 43/164* (2013.01); *E21B 43/267* (2013.01)

(58) Field of Classification Search
CPC ..... E21B 43/14; E21B 43/164; E21B 43/267
See application file for complete search history.

(56) References Cited

U.S. PATENT DOCUMENTS

| | | | | |
|---|---|---|---|---|
| 4,265,310 | A * | 5/1981 | Britton | E21B 43/2405 166/272.6 |
| 5,558,160 | A * | 9/1996 | Tudor | C09K 8/80 166/177.5 |
| 2016/0326853 | A1* | 11/2016 | Fredd | G06F 30/20 |
| 2019/0300781 | A1* | 10/2019 | Nguyen | E21B 43/267 |
| 2023/0134440 | A1* | 5/2023 | Decker | C09K 8/805 507/219 |
| 2024/0191607 | A1* | 6/2024 | AlMutairi | E21B 43/164 |

* cited by examiner

*Primary Examiner* — Silvana C Runyan
(74) *Attorney, Agent, or Firm* — Troutman Pepper Locke LLP

(57) ABSTRACT

A method for hydraulically fracturing a plurality of wells from a pad, includes (i) for each of the plurality of wells, alternating between perforation, injection of $CO_2$, and injection proppant-carrying fracturing fluid such that each stage of each well is hydraulically fractured in sequence and (ii) maintaining continuous $CO_2$ injection in at least one well from the pad.

18 Claims, 3 Drawing Sheets

100

200

300

CONTINUOUS CARBON DIOXIDE INJECTION DURING ZIPPER HYDRAULIC FRACTURING OPERATIONS

CROSS-REFERENCE TO RELATED APPLICATION

This application claims priority to and the benefit of U.S. Provisional Application No. 63/567,514, entitled "CONTINUOUS CARBON DIOXIDE INJECTION DURING ZIPPER HYDRAULIC FRACTURING OPERATIONS," having a filing date of Mar. 20, 2024, the disclosure of which is incorporated herein by reference in its entirety.

FIELD

This disclosure relates generally to the field of hydraulic fracturing operations. More specifically, this disclosure relates to methods for continuously injecting carbon dioxide ($CO_2$) during zipper hydraulic fracturing operations.

BACKGROUND

This section is intended to introduce various aspects of the art, which may be associated with aspects and embodiments of the present disclosure. This discussion is believed to assist in providing a framework to facilitate a better understanding of particular aspects and embodiments of the present disclosure. Accordingly, it should be understood that this section should be read in this light, and not necessarily as admissions of prior art.

A wellbore can be drilled into a subterranean formation to promote the removal (or production) of hydrocarbon fluids. In many cases, the subterranean formation needs to be stimulated in some manner to promote the removal of the hydrocarbon fluids. Stimulation includes any operation performed upon the matrix of a subterranean formation to improve fluid conductivity therethrough, including hydraulic fracturing, which is commonly used for unconventional reservoirs.

Hydraulic fracturing typically involves the pumping of large quantities of fracturing fluid into a subterranean formation (e.g., an unconventional, low-permeability formation) under high hydraulic pressure to promote the formation of one or more fractures within the matrix of the formation and to create high-conductivity flow paths. Primary fractures extending from the wellbore and, in some instances, secondary fractures extending from the primary fractures are formed during a hydraulic fracturing operation. These fractures may be vertical, horizontal, or a combination of directions forming a tortuous path.

Proppant particles are often included in the fracturing fluid. Once the fracturing fluid has been pumped into the subterranean formation, such proppant particles are transported into the fractures and settle therein. Upon pressure release, the proppant particles remaining in the fractures keep the fractures open by preventing them from collapsing, facilitating the flow of hydrocarbon fluids from the fractured formations into the wellbore through the propped fractures.

However, while hydraulic fracturing is a proven method for recovering hydrocarbon fluids from subterranean formations, the overall recovery factor is typically still low (e.g., typically less than 5% of the hydrocarbon fluids in place). Therefore, there is a genuine need for improved hydraulic fracturing methods in the industry. This disclosure satisfies these and other needs.

SUMMARY

An aspect of the present disclosure provides a method for hydraulically fracturing a plurality of wells from a pad. The method comprises, for each of the plurality of wells, alternating between perforation, injection of $CO_2$, and injection of proppant-carrying fracturing fluid such that each stage of each well is hydraulically fractured in sequence, as well as maintaining continuous $CO_2$ injection for the pad as a whole.

In some embodiments, the two or more wells comprise a first well and a second well. In such embodiments, the method may comprise: (1) performing steps (a) to (1) in the listed order: (a) perforating a first stage of the first well via a wireline; (b) perforating a first stage of the second well via the wireline; (c) injecting the $CO_2$ into the first stage of the first well; (d) injecting the proppant-carrying fracturing fluid into the first stage of the first well, while simultaneously injecting the $CO_2$ into the first stage of the second well; (e) perforating a second stage of the first well via the wireline, while the $CO_2$ is still being injected into the first stage of the second well; (f) injecting the $CO_2$ into the second stage of the first well, while simultaneously injecting the proppant-carrying fracturing fluid into the first stage of the second well; (g) perforating a second stage of the second well via the wireline, while the $CO_2$ is still being injected into the second stage of the first well; (h) injecting the proppant-carrying fracturing fluid into the second stage of the first well, while simultaneously injecting the $CO_2$ into the second stage of the second well; (i) perforating a third stage of the first well via the wireline, while the $CO_2$ is still being injected into the second stage of the second well; (j) injecting the $CO_2$ into the third stage of the first well, while simultaneously injecting the proppant-carrying fracturing fluid into the second stage of the second well; (k) perforating a third stage of the second well via the wireline, while the $CO_2$ is still being injected into the third stage of the first well; and (1) injecting the proppant-carrying fracturing fluid into the third stage of the first well, while simultaneously injecting the $CO_2$ into the third stage of the second well; and (2) repeating steps (i) to (1) for subsequent stages of the first well and the second well.

In other embodiments, the two or more wells comprise a first well, a second well, and a third well. In such embodiments, the method may comprise: (1) performing steps (a) to (g) in the listed order: (a) perforating a first stage of the first well via a wireline; (b) perforating a first stage of the second well via the wireline; (c) injecting the $CO_2$ into the first stage of the first well; (d) injecting the proppant-carrying fracturing fluid into the first stage of the first well, while simultaneously injecting the $CO_2$ into the first stage of the second well and perforating a first stage of the third well; (e) perforating a second stage of the first well, while simultaneously injecting the proppant-carrying fracturing fluid into the first stage of the second well and injecting the $CO_2$ into the first stage of the third well; (f) injecting the $CO_2$ into the second stage of the first well, while simultaneously perforating the second stage of the second well and injecting the proppant-carrying fracturing fluid into the first stage of the third well; and (g) injecting the proppant-carrying fracturing fluid into the second stage of the first well, while simultaneously injecting the $CO_2$ into the second stage of the second well and perforating the second stage of the third well; and (2) repeating steps (e) to (g) for subsequent stages of the first well, the second well, and the third well.

In other embodiments, the two or more wells comprise a first well, a second well, a third well, and a fourth well. In such embodiments, the method may comprise: (1) performing steps (a) to (g) in the listed order: (a) perforating a first stage of the first well via a wireline; (b) perforating a first stage of the second well via the wireline; (c) injecting the $CO_2$ into the first stage of the first well; (d) injecting the proppant-carrying fracturing fluid into the first stage of the first well, while simultaneously injecting the $CO_2$ into the first stage of the second well and perforating a first stage of the third well; (e) perforating a first stage of the fourth well, while simultaneously injecting the proppant-carrying fracturing fluid into the first stage of the second well and injecting the $CO_2$ into the first stage of the third well; (f) injecting the $CO_2$ into the first stage of the fourth well, while simultaneously perforating the second stage of the first well and injecting the proppant-carrying fracturing fluid into the first stage of the third well; and (g) injecting the proppant-carrying fracturing fluid into the first stage of the fourth well, while simultaneously injecting the $CO_2$ into the second stage of the first well and perforating the second stage of the second well; and (2) repeating steps (e) to (g) for subsequent stages of the first well, the second well, the third well, and the fourth well.

Moreover, in other embodiments, the two or more wells may further include a fifth well, a sixth well, a seventh well, or even more wells, depending on the details of the particular implementation. In such embodiments, the steps of the method may be adjusted accordingly.

These and other features and attributes of the disclosed aspects and embodiments of the present disclosure and their advantageous applications and/or uses will be apparent from the detailed description that follows.

BRIEF DESCRIPTION OF THE DRAWINGS

To assist those of ordinary skill in the relevant art in making and using the subject matter described herein, reference is made to the appended drawings, where.

Figure 1:
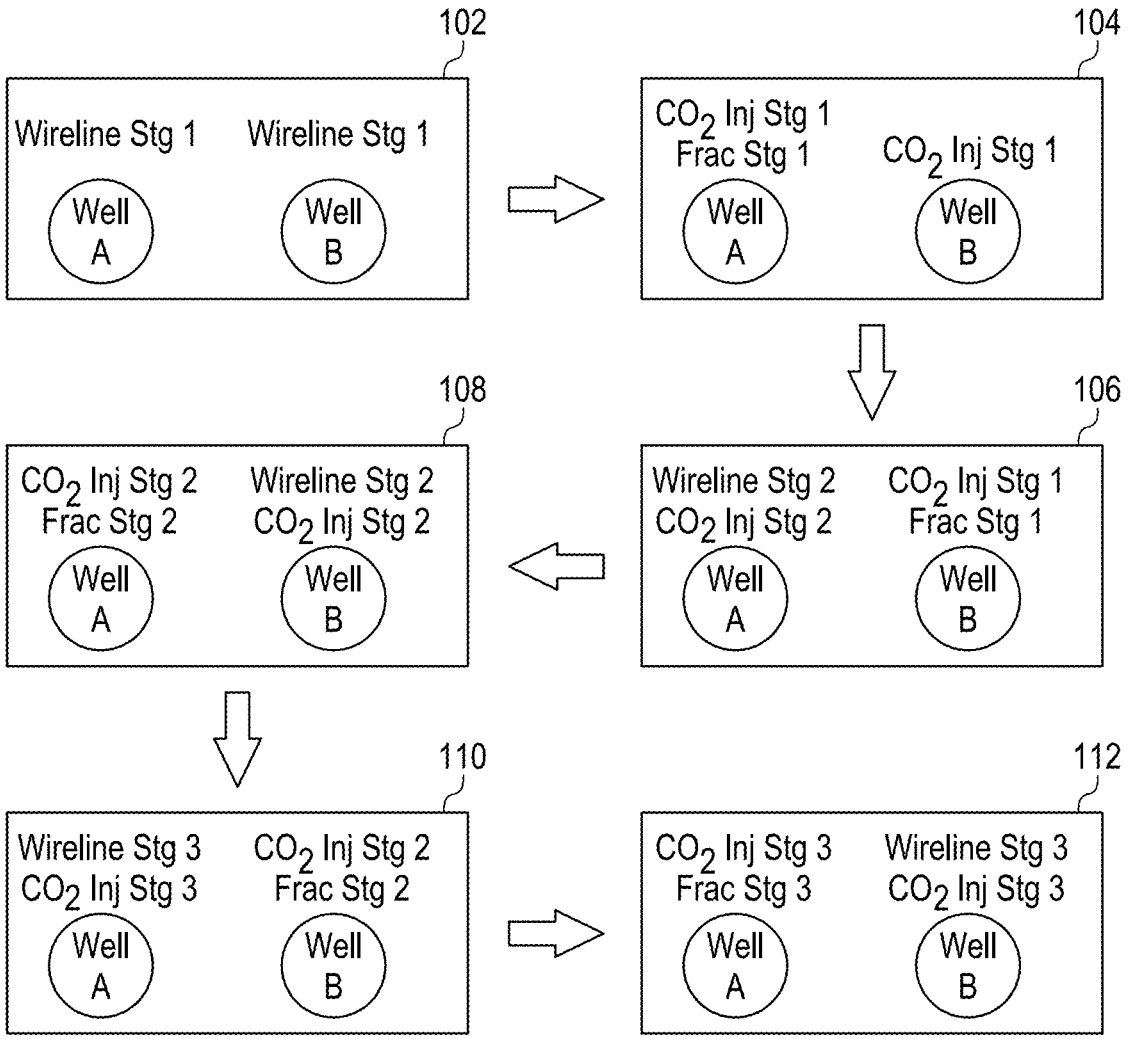
FIG. 1 is a process flow diagram of an exemplary two-well zipper hydraulic fracturing process with continuous $CO_2$ injection.

It should be noted that the figures are merely examples of the present disclosure and are not intended to impose limitations on the scope of the present disclosure. Further, the figures are generally not drawn to scale, but are drafted for purposes of convenience and clarity in illustrating various aspects of the present disclosure.

DETAILED DESCRIPTION

In the following detailed description section, the specific examples of the present disclosure are described in connection with preferred aspects and embodiments. However, to the extent that the following description is specific to one or more aspects or embodiments of the present disclosure, this is intended to be for exemplary purposes only and simply provides a description of such aspect(s) or embodiment(s). Accordingly, the present disclosure is not limited to the specific aspects and embodiments described below, but rather, includes all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition those skilled in the art have given that term as reflected in at least one printed publication or issued patent. Further, the present disclosure is not limited by the usage of the terms shown below, as all equivalents, synonyms, new developments, and terms or processes that serve the same or a similar purpose are considered to be within the scope of the present claims.

As used herein, the singular forms "a," "an," and "the" mean one or more when applied to any embodiment described herein. The use of "a," "an," and/or "the" does not limit the meaning to a single feature unless such a limit is specifically stated.

The terms "about" and "around" mean a relative amount of a material or characteristic that is sufficient to provide the intended effect. The exact degree of deviation allowable in some cases may depend on the specific context, e.g., ±1%, ±5%, ±10%, ±15%, etc. It should be understood by those of skill in the art that these terms are intended to allow a description of certain features described and claimed without restricting the scope of these features to the precise numerical ranges provided. Accordingly, these terms should be interpreted as indicating that insubstantial or inconsequential modifications or alterations of the subject matter described are considered to be within the scope of the disclosure.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the terms "example," exemplary," and "embodiment," when used with reference to one or more components, features, structures, or methods according to the present disclosure, are intended to convey that the described component, feature, structure, or method is an illustrative, non-exclusive example of components, features, structures, or methods according to the present disclosure. Thus, the described component, feature, structure, or method is not intended to be limiting, required, or exclusive/exhaustive; and other components, features, structures, or methods, including structurally and/or functionally similar and/or equivalent components, features, structures, or methods, are also within the scope of the present disclosure.

The term "fracture" (or "hydraulic fracture") refers to a crack or surface of breakage within a subterranean formation, that can be induced by an applied pressure or stress.

The term "petroleum coke" refers to a final carbon-rich solid material that is derived from oil refining. More specifically, petroleum coke is the carbonization product of high-boiling hydrocarbon fractions that are obtained as a result of petroleum processing operations. Petroleum coke is produced within a coking unit via a thermal cracking process in which long-chain hydrocarbons are split into shorter-chain hydrocarbons. As described herein, there are at least three main types of petroleum coke: delayed coke, fluid coke, and flexicoke. Each type of petroleum coke is produced using a different coking process; however, all three coking processes have the common objective of maximizing the yield of distillate products within a refinery by rejecting large quantities of carbon in the residue as petroleum coke.

As used herein, the terms "proppant" and "proppant particle" as used herein refer to a solid material capable of maintaining open an induced fracture during and following a hydraulic fracturing treatment. The term "conventional proppant" as used herein refers to sand and other types of traditional proppants that do not include coke particles. The term "lightweight proppant (LWP)" refers to proppants having an apparent density within a range of from around 1.2 g/cm$^3$ to around 2.0 g/cm$^3$ (e.g., from around 1.2, 1.3, 1.4, 1.5 g/cm$^3$ to around 1.7, 1.8, 1.9, 2.0 g/cm$^3$), while the term "ultra-lightweight proppant (ULWP)" refers to proppants having an apparent density within a range of from around 0.5 g/cm$^3$ to around 1.2 g/cm$^3$ (e.g., from around 0.5, 0.6, 0.7, 0.8 g/cm$^3$ to around 0.9, 1.0, 1.1, 1.2 g/cm$^3$). The term "microproppant" means proppant particles having particle sizes of at most 105 μm (140 mesh).

Relatedly, the term "coke proppant particles" refers to coated or uncoated coke particles that can be utilized as proppant, which may include, for example, fluid coke particles, flexicoke particles, delayed coke particles, thermally post-treated coke particles, pyrolysis coke particles, and/or coal-derived coke particles (e.g., blast furnace coke particles and/or metallurgical coke particles). The term "microproppant coke particles" refers to coke proppant particles having particle sizes of at most 105 μm, but potentially within a range from around 0.0001 μm to 105 μm (e.g., from around 0.0001, 0.001, 0.01, 0.1 μm to 0.5, 1.0, 2.0, 5.0, 8.0 10 μm, to 15, 20, 25, 30, 35, 40, 45 μm, to 50, 53, 55, 60, 63, 65 μm, to 74, 75, 80, 85, 88, 90, 95, 100, 105 μm).

The term "substantially," when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

The term "wellbore" refers to a borehole drilled into a subterranean formation. The borehole may include vertical, deviated, highly deviated, and/or lateral sections. The term "wellbore" also includes the downhole equipment associated with the borehole, such as the casing strings, production tubing, gas lift valves, and other subsurface equipment. Relatedly, the term "hydrocarbon well" (or simply "well") includes the wellbore in addition to the wellhead and other associated surface equipment.

The term "zipper hydraulic fracturing" refers to the hydraulic fracturing of multiple wells in sequence. More specifically, zipper hydraulic fracturing typically involves drilling two or more wells from a common pad (which may be a portion or the entirety of all wells from the pad) and then hydraulically fracturing stages of each well in sequence. For example, a stage of one well may be hydraulically fractured while a stage of another well from the same pad is perforated in preparation for hydraulic fracturing, and the hydraulic fracturing operation can then alternate between the stages of the multiple wells in a zipper-like pattern.

Certain embodiments and features are described herein using a set of numerical upper limits and a set of numerical lower limits. It should be appreciated that ranges from any lower limit to any upper limit are contemplated unless otherwise indicated. All numerical values are "about", "around," or "approximately" the indicated value, and account for experimental errors and variations that would be expected by a person having ordinary skill in the art.

Furthermore, concentrations, dimensions, amounts, and/or other numerical data that are presented in a range format are to be interpreted flexibly to include not only the numerical values explicitly recited as the limits of the range, but also all individual numerical values or sub-ranges encompassed within that range, as if each numerical value and sub-range were explicitly recited. For example, a disclosed numerical range of 1 to 200 should be interpreted to include, not only the explicitly-recited limits of 1 and 200, but also individual values, such as 2, 3, 4, 197, 198, 199, etc., as well as sub-ranges, such as 10 to 50, 20 to 100, etc.

Hydraulic fracturing methods are used extensively for increasing the productivity of unconventional subterranean formations, which are subterranean formations with very low permeability that typically do not produce economically without stimulation. Examples of unconventional subterranean formations include tight sandstone formations, tight carbonate formations, shale gas formations, coal bed methane formations, and tight oil formations. Moreover, in recent years, zipper hydraulic fracturing methods have been adopted to enable multiple horizontal wells extending from a single pad site to be quickly and efficiently hydraulically fractured in sequence, thus saving time and resources for the overall hydraulic fracturing operation. However, even with the utilization of more advanced hydraulic fracturing methods, the overall recovery factor for hydraulically-fractured wells is typically still low (e.g., typically less than 5% of the hydrocarbon fluids in the surrounding formation).

Hydraulic fracturing methods utilizing carbon dioxide ($CO_2$) have been proposed to increase the recovery factor. The utilization of $CO_2$ during hydraulic fracturing provides several advantages. Greenhouse gases in the atmosphere may be reduced through the sequestration of $CO_2$ within the formation. $CO_2$ may energize the formation, leading to the creation of more complex fracture networks. In addition, $CO_2$ may react with carbonates within the formation, which may lead to an increase in formation permeability. Furthermore, $CO_2$ may undergo imbibition onto the formation rock, thereby displacing oil within the formation and promoting the flow of oil into the wellbore.

However, despite such advantages, the utilization of $CO_2$ can be problematic given the cyclic operational nature of hydraulically fracturing multiple stages of wells. In particular, a significant amount $CO_2$ is undesirably lost to the atmosphere during each charge up and blow down of the $CO_2$ pump for fracturing each separate stage. This issue is particularly pronounced for current zipper hydraulic fracturing methods, which rely on the injection of $CO_2$ during a limited portion of each operation. This effectively limits the amounts of $CO_2$ that is injected per stage, while also resulting in the undesirable release of large amounts of $CO_2$ into the atmosphere during charge up and blow down of the $CO_2$ pump. As an example, if $CO_2$ is injected during the pad phase only and then followed by the injection of the proppant-carrying fracturing fluid, around 5 to 15 tons of $CO_2$ may be lost to the atmosphere between each stage.

Therefore, the present disclosure alleviates the foregoing difficulty and provides related advantages as well. Specifically, the present disclosure provides methods for continuously injecting $CO_2$ during zipper hydraulic fracturing operations, thus decreasing the amount of $CO_2$ that is released into the atmosphere. In other words, because $CO_2$ is continuously injected during zipper hydraulic fracturing according to aspects and embodiments described herein, the $CO_2$ pump no longer has to undergo charge up and blow down between each stage. As a result, the amount of $CO_2$ that is leaked to the atmosphere is substantially reduced. Moreover, the aforementioned advantages of utilizing $CO_2$ may be enhanced since a larger volume of $CO_2$ is injected into the formation.

There are several different types of $CO_2$ fracturing, including $CO_2$ foam fracturing, $CO_2$ dry fracturing, and supercritical $CO_2$ fracturing, for example. First, with regard to $CO_2$ foam fracturing, liquid $CO_2$ is initially stored in $CO_2$ tankers and is then pressurized to the desired pressure within the $CO_2$ pump. The liquid $CO_2$ is mixed with an aqueous fluid to form a $CO_2$ foam and is then pumped to the bottom of the wellbore, at which point the temperature rises high enough to cause the $CO_2$ to enter the supercritical state. After flowback starts, the $CO_2$ pressure gradually declines, and a portion of the $CO_2$ may flow back to the surface in the gaseous phase.

With regard to $CO_2$ dry fracturing, liquid $CO_2$ is initially stored in $CO_2$ tankers and is then pressurized to the desired pressure within a high-pressure $CO_2$ pump. The liquid $CO_2$ is then pumped to the bottom of the wellbore, at which point the temperature rises high enough to cause the $CO_2$ to enter the supercritical state. After flowback starts, the $CO_2$ pressure rapidly declines, and a portion of the $CO_2$ may flow back to the surface in the gaseous phase.

With regard to supercritical $CO_2$ fracturing, liquid $CO_2$ is initially stored in $CO_2$ tankers and is then pressurized to the desired pressure within a high-pressure $CO_2$ pump. In some cases, the $CO_2$ is also heated at the surface. The liquid $CO_2$ is then pumped to the bottom of the wellbore, at which point the temperature and pressure rise high enough to cause the $CO_2$ to enter the supercritical state. Notably, during supercritical $CO_2$ fracturing, $CO_2$ reaches the supercritical state at an earlier point in time than during $CO_2$ foam fracturing or $CO_2$ dry fracturing; specifically, $CO_2$ reaches the supercritical state prior to reaching the perforations. Similarly to $CO_2$ dry fracturing, after flowback starts, the $CO_2$ pressure rapidly declines, and a portion of the $CO_2$ may flow back to the surface in the gaseous phase.

The different types of $CO_2$ fracturing do not differ substantially in procedure, however, since $CO_2$ enters the supercritical state at downhole conditions regardless of the type of $CO_2$ fracturing that is utilized. Moreover, while the aspects and embodiments provided herein are primarily described with respect to supercritical $CO_2$ fracturing, it is to be understood that the aspects and embodiments provided herein can be equally applied to the other types of $CO_2$ fracturing.

According to aspects and embodiments described herein, the $CO_2$ fracturing is performed according to a hybrid approach, in which $CO_2$ is injected during the pad phase only, followed by the injection of the proppant-carrying fracturing fluid during the remainder of the fracturing operation. More specifically, for each stage of each well, $CO_2$ may be injected at a pump rate of around 1 barrels per minute (bbl/min) to around 150 bbl/min (e.g., from 1, 2, 4, 5, 6, 8, 10 bbl/min to 15, 20, 25, 30, 35, 40, 45, 50 bbl/min, to 60, 70, 80, 90, 100 bbl/min, to 110, 120, 130, 140, 150 bbl/min) and a pressure of around 5,000 psi to around 12,000 psi (e.g., from 5,000, 5,500, 6,000, 6,500, 7,000, 7,500 psi to 8,000, 8,500, 9,000, 9,500, 10,000 psi, to 10,500, 11,000, 11,500, 12,000 psi), for example, during the pad phase. In some embodiments, a total of around 10 bbl to around 10,000 bbl (e.g., from 10, 50, 100, 500, 1,000 bbl, to 2,000, 3,000, 4,000, 5,000 bbl, to 6,000, 7,000, 8,000, 9,000, 10,000 bbl), for example, of $CO_2$ may be injected per stage. Subsequently, a fracturing fluid including proppant particles may be injected at a pump rate of around 10 bbl/min to around 150 bbl/min (e.g., from 1, 2, 4, 5, 6, 8, 10 bbl/min to 15, 20, 25, 30, 35, 40, 45, 50 bbl/min, to 60, 70, 80, 90, 100 bbl/min, to 110, 120, 130, 140, 150 bbl/min), with a total of around 400,000 pounds (lb) to around 600,000 lb (e.g., from 400, 000, 450,000, 500,000 to 550,000, 600,000 lb), for example, of proppant particles potentially being injected per stage.

The proppant-carrying fracturing fluid may be formed from any suitable type of carrier fluid and may include any suitable type(s) of proppant. With respect to the proppant, such proppant may include but is not limited to one or more types of conventional proppant (e.g., sand, crushed granite, ceramic beads, and/or other granular materials), LWP, ULWP, and/or coke proppant particles. For embodiments in which coke proppant particles are utilized as at least a portion of the proppant, such coke proppant particles may include but are not limited to fluid coke particles, flexicoke particles, delayed coke particles, thermally post-treated coke particles, pyrolysis coke particles, coal-derived coke particles (e.g., blast furnace coke particles and/or metallurgical coke particles), or any combination thereof. Moreover, in some embodiments, at least a portion of such coke proppant particles may be provided as microproppant coke particles, which may include but are not limited to wet flexicoke fines, dry flexicoke fines, sieved fluid coke, sieved flexicoke, sieved delayed coke, sieved thermally post-treated coke, sieved pyrolysis coke, sieved coal-derived coke, ground fluid coke, ground flexicoke, ground delayed coke, ground thermally post-treated coke, ground pyrolysis coke, and/or ground coal-derived coke. In such embodiments, the microproppant coke particles have a particle size of at most 105 μm (140 mesh) or, in some cases, a particle size of at most 88 μm (170 mesh), but potentially within a range from around 0.0001 μm to 105 μm (e.g., from around 0.0001, 0.001, 0.01, 0.1 μm to 0.5, 1.0, 2.0, 5.0, 8.0 10 μm, to 15, 20, 25, 30, 35, 40, 45 μm, to 50, 53, 55, 60, 63, 65 μm, to 74, 75, 80, 85, 88, 90, 95, 100, 105 μm).

With respect to the carrier fluid for the proppant-carrying fracturing fluid, such carrier fluid may be an aqueous carrier fluid that includes water or a nonaqueous carrier fluid that is substantially free of water. Aqueous carrier fluids may include, for example, fresh water, salt water (including seawater), treated water (e.g., treated production water), one or more other forms of aqueous fluid, or any combination thereof. One aqueous carrier fluid class is often referred to as slickwater, and the corresponding fracturing operations are often referred to as slickwater fracturing operations. Nonaqueous carrier fluids may include, for example, oil-based fluids (e.g., hydrocarbon, olefin, mineral oil), alcohol-based fluids (e.g., methanol), or any combination thereof. In various embodiments, the viscosity of the carrier fluid may be altered by foaming or gelling. Foaming may be achieved using, for example, air or other gases (e.g., $CO_2$, $N_2$), alone or in combination. Gelling may be achieved using, for example, guar gum (e.g., hydroxypropyl guar), cellulose, or other gelling agents, which may or may not be crosslinked using one or more crosslinkers, such as polyvalent metal ions or borate anions, among other suitable crosslinkers.

In some embodiments, the proppant-carrying fracturing fluid may also include one or more additives. Such additives may include but are not limited to one or more acids, one or more biocides, one or more breakers, one or more corrosion inhibitors, one or more crosslinkers, one or more friction reducers (e.g., polyacrylamides), one or more gels, one or more oxygen scavengers, one or more pH control additives, one or more scale inhibitors, one or more surfactants, one or more weighting agents, one or more inert solids, one or more fluid loss control agents, one or more emulsifiers, one or more emulsion thinners, one or more emulsion thickeners, one or more viscosifying agents, one or more foaming agents, one or more stabilizers, one or more chelating agents, one or more mutual solvents, one or more oxidizers, one or more reducers, one or more clay stabilizing agents, or any combination thereof.

In various embodiments, the methods described herein may be performed in drilled hydrocarbon-producing wellbores including vertical, deviated, highly deviated, and/or lateral sections. Such wellbores may be drilled into various types of unconventional subterranean formations, including but not limited to tight sandstone formations, tight carbonate formations, shale gas formations, coal bed methane formations, and/or tight oil formations.

In various embodiments, the utilized $CO_2$ may be obtained from any suitable sources. For example, at least a portion of the $CO_2$ may be obtained from industrial sites (e.g., plants). In this manner, the present disclosure advantageously provides for the sequestration and long-term storage of $CO_2$ that would have otherwise been undesirably released into the atmosphere.

Turning to details of exemplary implementations of the aspects and embodiments described herein for various multi-well pad configurations, FIG. 1 is a process flow diagram of an exemplary two-well zipper hydraulic fracturing process 100 with continuous $CO_2$ injection. As shown in FIG. 1, the two wells are referred to as "Well A" and "Well B" for ease of discussion. The process 100 begins at block 102, at which stage 1 of Well A and stage 1 of Well B are both perforated by means of a wireline. In various embodiments, when a single wireline is used, Well A may be perforated first, followed by Well B. At block 104, $CO_2$ injection is performed during the pad phase for stage 1 of Well A. The proppant-carrying fracturing fluid is then injected into stage 1 of Well A to cause the propagation of hydraulic fractures within the formation, while $CO_2$ is simultaneously injected during the pad phase for stage 1 of Well B.

At block 106, stage 2 of Well A is perforated by means of a wireline, while $CO_2$ injection continues for stage 1 of Well B. Once the wireline operation is completed for stage 2 of Well A, $CO_2$ is injected during the pad phase for stage 2 of Well A, while the proppant-carrying fracturing fluid is then injected into stage 1 of Well B. At block 108, stage 2 of Well B is perforated by means of a wireline, while $CO_2$ injection continues for stage 2 of Well A. Once the wireline operation is completed for stage 2 of Well B, $CO_2$ is injected during the pad phase for stage 2 of Well B, while the proppant-carrying fracturing fluid is then injected into stage 2 of Well A.

At block 110, stage 3 of Well A is perforated by means of a wireline, while $CO_2$ injection continues for stage 2 of Well B. Once the wireline operation is completed for stage 3 of Well A, $CO_2$ is injected during the pad phase for stage 3 of Well A, while the proppant-carrying fracturing fluid is then injected into stage 2 of Well B. At block 112, stage 3 of Well B is perforated by means of a wireline, while $CO_2$ injection continues for stage 3 of Well A. Once the wireline operation is completed for stage 3 of Well B, $CO_2$ is injected during the pad phase for stage 3 of Well B, while the proppant-carrying fracturing fluid is then injected into stage 3 of Well A. Moreover, this process may be repeated for every stage of Wells A and B. In this manner, continuous $CO_2$ injection is maintained during the zipper hydraulic fracturing operation, reducing the leakage of $CO_2$ into the atmosphere during charge up and blow down of the $CO_2$ pump.

Figure 2:
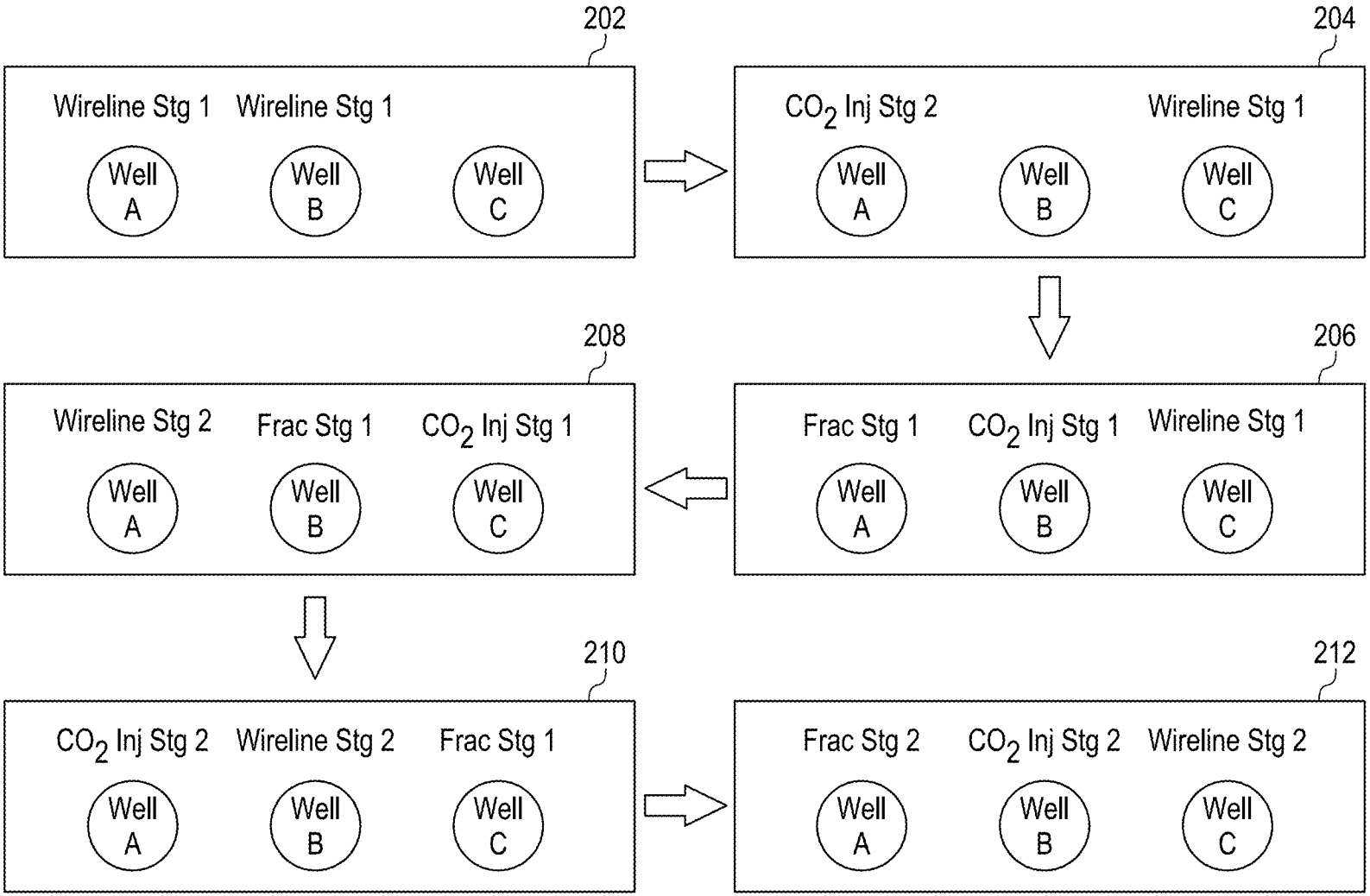
FIG. 2 is a process flow diagram of an exemplary three-well zipper hydraulic fracturing process with continuous $CO_2$ injection.

FIG. 2 is a process flow diagram of an exemplary three-well zipper hydraulic fracturing process 200 with continuous $CO_2$ injection. As shown in FIG. 2, the three wells are referred to as "Well A," "Well B," and "Well C" for ease of discussion. The process 200 begins at block 202, at which stage 1 of Well A and stage 1 of Well B are both perforated by means of a wireline. In various embodiments, when a single wireline is used, Well A may be perforated first, followed by Well B. At block 204, $CO_2$ injection is performed during the pad phase for stage 1 of Well A, and the proppant-carrying fracturing fluid is then injected into stage 1 of Well A to cause the propagation of hydraulic fractures within the formation. At the same time, stage 1 of Well C is perforated by means of a wireline.

At block 206, while stage 1 of Well A is being fractured via the injection of the proppant-carrying fracturing fluid and stage 1 of Well C is being perforated, $CO_2$ is injected during the pad phase for stage 1 of Well B. At block 208, the wireline is used to perforate stage 2 of Well A; the proppant-carrying fracturing fluid is injected into stage 1 of Well B; and $CO_2$ is injected into stage 1 of Well C.

At block 210, $CO_2$ is injected into stage 2 of Well A; the wireline is used to perforate stage 2 of Well B; and the proppant-carrying fracturing fluid is injected into stage 1 of Well C. At block 212, the proppant-carrying fracturing fluid is injected for stage 2 of Well A; $CO_2$ is injected into stage 2 of Well B; and the wireline is used to perforate stage 2 of Well C. Moreover, this process may be repeated for every stage of Wells A, B, and C. In this manner, continuous $CO_2$ injection is maintained during the zipper hydraulic fracturing operation, reducing the leakage of $CO_2$ into the atmosphere during charge up and blow down of the $CO_2$ pump.

Figure 3:
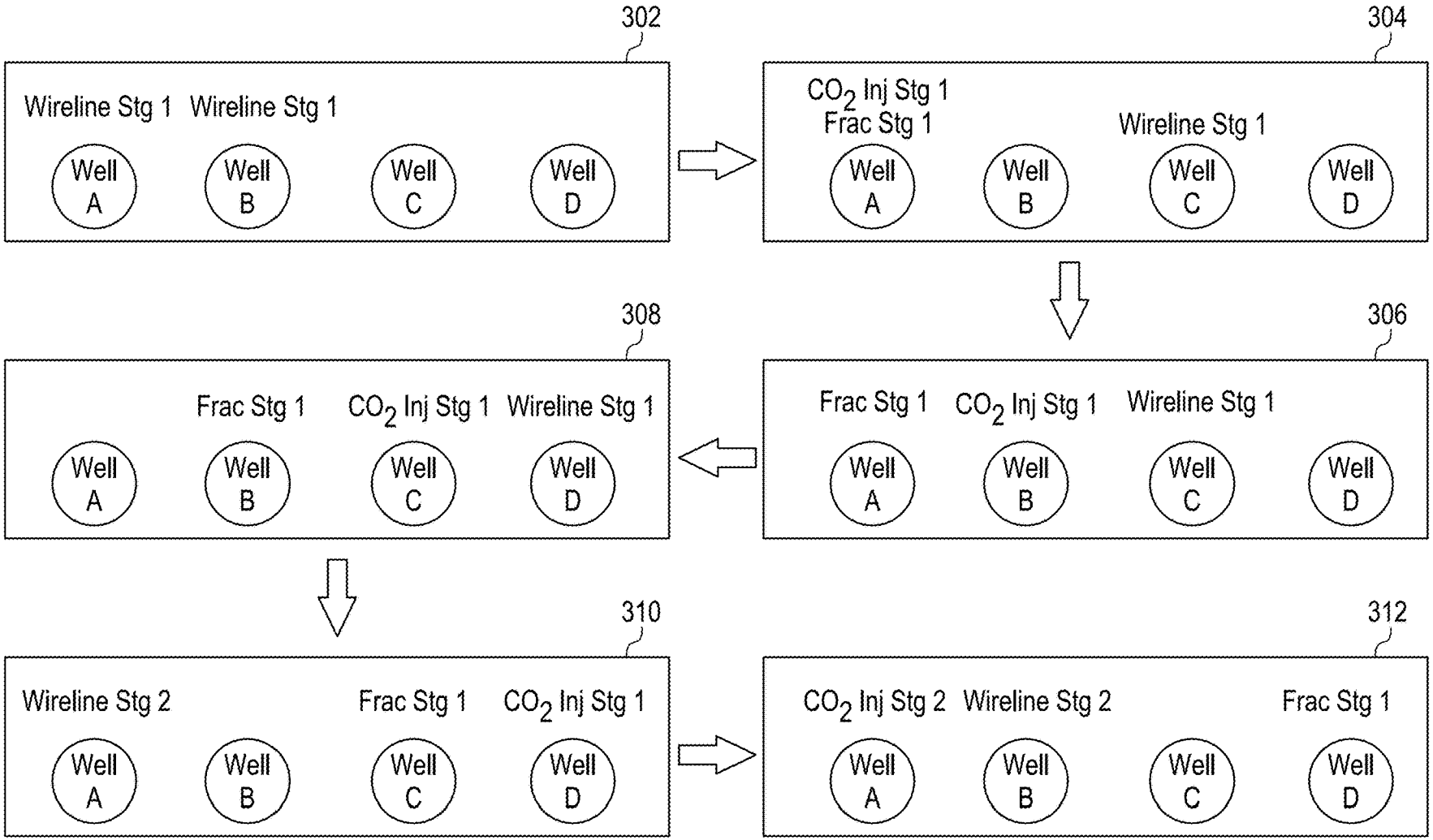
FIG. 3 is a process flow diagram of an exemplary four-well zipper hydraulic fracturing process with continuous $CO_2$ injection.

FIG. 3 is a process flow diagram of an exemplary four-well zipper hydraulic fracturing process 300 with continuous $CO_2$ injection. As shown in FIG. 3, the four wells are referred to as "Well A," "Well B," "Well C," and "Well D" for ease of discussion. The process 300 begins at block 302, at which stage 1 of Well A and stage 1 of Well B are both perforated by means of a wireline. In various embodiments, when a single wireline is used, Well A may be perforated first, followed by Well B. At block 304, $CO_2$ injection is performed during the pad phase for stage 1 of Well A, and the proppant-carrying fracturing fluid is then injected into stage 1 of Well A to cause the propagation of hydraulic fractures within the formation. At the same time, stage 1 of Well C is perforated by means of a wireline.

At block 306, while stage 1 of Well A is being fractured via the injection of the proppant-carrying fracturing fluid and stage 1 of Well C is being perforated, $CO_2$ is injected during the pad phase for stage 1 of Well B. At block 308, the wireline is used to perforate stage 1 of Well D; proppant-carrying fracturing fluid is injected into stage 1 of Well B; and $CO_2$ is injected into stage 1 of Well C.

At block 310, the wireline is used to perforate stage 2 of Well A; the proppant-carrying fracturing fluid is injected into stage 1 of Well C; and $CO_2$ is injected into stage 1 of Well D. At block 312, $CO_2$ is injected into stage 2 of Well A; the wireline is used to perforate stage 2 of Well B; and the proppant-carrying fracturing fluid is injected into stage 1 of Well D. Moreover, this process may be repeated for every stage of Wells A, B, C, and D. In this manner, continuous $CO_2$ injection is maintained during the zipper hydraulic fracturing operation, reducing the leakage of $CO_2$ into the atmosphere during charge up and blow down of the $CO_2$ pump.

The processes 100, 200, and 300 of FIGS. 1, 2, and 3, respectively, can be modified in any suitable manner to provide a multi-well zipper hydraulic fracturing process with continuous $CO_2$ injection, without departing from the scope of the present application. Moreover, the four-well zipper hydraulic fracturing process 300 of FIG. 3 can be easily extended to configurations including five wells, six wells, or even more wells, depending on the details of the particular multi-well pad site.

According to aspects and embodiments described herein, a method is provided for performing zipper hydraulic fracturing with continuous $CO_2$ injection. The method includes, for two or more wells in a pad, alternating between perforation, injection of $CO_2$, and injection of proppant-carrying fracturing fluid such that each stage of each well is hydraulically fractured in sequence with continuous $CO_2$ injection for the pad. In various embodiments, the injection of the $CO_2$ is performed during a pad phase for each stage, and the injection of the proppant-carrying fracturing fluid is performed for a remainder of the fracturing operation for each stage.

In some embodiments, the $CO_2$ is injected as supercritical $CO_2$. In other embodiments, the $CO_2$ is injected as $CO_2$ foam. In other embodiments, the $CO_2$ is injected as liquid $CO_2$.

In various embodiments, the proppant-carrying fluid includes a carrier fluid, one or more types of proppant particles, and (optionally) one or more additives. In some embodiments, at least a portion of the proppant particles include coke proppant particles. Moreover, in such embodiments, at least a portion of the coke proppant particles may include microproppant coke particles.

In some embodiments, the $CO_2$ is injected at a pump rate in a range from 1 bbl/min to 150 bbl/min (e.g., 1, 5, 10, 15, 20, 25 bbl/min, to 30, 35, 40, 45, 50, 55 bbl/min, to 60, 65, 70, 75, 80, 85 bbl/min, to 90, 95, 100, 105, 110, 115 bbl/min, to 120, 125, 130, 135, 140, 145, 150 bbl/min). In some embodiments, the $CO_2$ is injected at a pressure in a range from 5,000 psi to 12,000 psi (e.g., 5,000, 5,500, 6,000, 6,500, 7,000 psi, to 7,500, 8,000, 8,500, 9,000, 9,500 psi, to 10,000, 10,500, 11,000, 11,500, 12,000 psi). In some embodiments, the $CO_2$ is injected at a temperature in a range from −60 degrees Fahrenheit (° F.) at surface to 70° F. at surface (e.g., −60, −50, −40, −30° F., to −20, −10, 0, 10, 20° F., to 30, 40, 50, 60, 70° F.). In some embodiments, the amount of $CO_2$ injected for each stage is in a range from 10 barrels (bbl) to 10,000 bbl (e.g., 10, 100, 500, 1,000 bbl, to 2,000, 3,000, 4,000, 5,000 bbl, to 6,000, 7,000, 8,000, 9,000, 10,000 bbl). Moreover, in some embodiments, the proppant-carrying fracturing fluid is injected at a pump rate in a range from 10 bbl/min to 150 bbl/min (e.g., 10, 30, 50, 70 bbl/min, to 90, 110, 130, 150 bbl/min).

In various embodiments, the two or more wells includes a total of two to ten wells in the pad. In various embodiments, the wells are unconventional wells, as described herein. In addition, in various embodiments, at least a portion of the $CO_2$ is sourced from industrial sites that would have otherwise released at least a portion of the $CO_2$ into the atmosphere, as also described herein.

In one specific embodiment, two wells (i.e., a first well and a second well) are included in the pad. In such embodiment, the method may include: (1) performing steps (a) to (1) in the listed order: (a) perforating a first stage of the first well via a wireline; (b) perforating a first stage of the second well via the wireline; (c) injecting the $CO_2$ into the first stage of the first well; (d) injecting the proppant-carrying fracturing fluid into the first stage of the first well, while simultaneously injecting the $CO_2$ into the first stage of the second well; (e) perforating a second stage of the first well via the wireline, while the $CO_2$ is still being injected into the first stage of the second well; (f) injecting the $CO_2$ into the second stage of the first well, while simultaneously injecting the proppant-carrying fracturing fluid into the first stage of the second well; (g) perforating a second stage of the second well via the wireline, while the $CO_2$ is still being injected into the second stage of the first well; (h) injecting the proppant-carrying fracturing fluid into the second stage of the first well, while simultaneously injecting the $CO_2$ into the second stage of the second well; (i) perforating a third stage of the first well via the wireline, while the $CO_2$ is still being injected into the second stage of the second well; (j) injecting the $CO_2$ into the third stage of the first well, while simultaneously injecting the proppant-carrying fracturing fluid into the second stage of the second well; (k) perforating a third stage of the second well via the wireline, while the $CO_2$ is still being injected into the third stage of the first well; and (1) injecting the proppant-carrying fracturing fluid into the third stage of the first well, while simultaneously injecting the $CO_2$ into the third stage of the second well; and (2) repeating steps (i) to (1) for subsequent stages of the first well and the second well.

In another specific embodiment, three wells (i.e., a first well, a second well, and a third well) are included in the pad. In such embodiment, the method may include: (1) performing steps (a) to (g) in the listed order: (a) perforating a first stage of the first well via a wireline; (b) perforating a first stage of the second well via the wireline; (c) injecting the $CO_2$ into the first stage of the first well; (d) injecting the proppant-carrying fracturing fluid into the first stage of the first well, while simultaneously injecting the $CO_2$ into the first stage of the second well and perforating a first stage of the third well; (e) perforating a second stage of the first well, while simultaneously injecting the proppant-carrying fracturing fluid into the first stage of the second well and injecting the $CO_2$ into the first stage of the third well; (f) injecting the $CO_2$ into the second stage of the first well, while simultaneously perforating the second stage of the second well and injecting the proppant-carrying fracturing fluid into the first stage of the third well; and (g) injecting the proppant-carrying fracturing fluid into the second stage of the first well, while simultaneously injecting the $CO_2$ into the second stage of the second well and perforating the second stage of the third well; and (2) repeating steps (e) to (g) for subsequent stages of the first well, the second well, and the third well.

In another specific embodiment, four wells (i.e., a first well, a second well, a third well, and a fourth well) are included in the pad. In such embodiment, the method may include: (1) performing steps (a) to (g) in the listed order: (a) perforating a first stage of the first well via a wireline; (b) perforating a first stage of the second well via the wireline; (c) injecting the $CO_2$ into the first stage of the first well; (d) injecting the proppant-carrying fracturing fluid into the first stage of the first well, while simultaneously injecting the $CO_2$ into the first stage of the second well and perforating a first stage of the third well; (e) perforating a first stage of the fourth well, while simultaneously injecting the proppant-carrying fracturing fluid into the first stage of the second well and injecting the $CO_2$ into the first stage of the third well; (f) injecting the $CO_2$ into the first stage of the fourth well, while simultaneously perforating the second stage of the first well and injecting the proppant-carrying fracturing fluid into the first stage of the third well; and (g) injecting the proppant-carrying fracturing fluid into the first stage of the fourth well, while simultaneously injecting the $CO_2$ into the second stage of the first well and perforating the second stage of the second well; and (2) repeating steps (e) to (g) for subsequent stages of the first well, the second well, the third well, and the fourth well.

While the embodiments described herein are well-calculated to achieve the advantages set forth, it will be appreciated that such embodiments are susceptible to modification, variation, and change without departing from the spirit thereof. In other words, the particular embodiments described herein are illustrative only, as the teachings of the present disclosure may be modified and practiced in different but equivalent manners apparent to those skilled in the art having the benefit of the teachings herein. Moreover, the systems and methods illustratively disclosed herein may suitably be practiced in the absence of any element that is not specifically disclosed herein and/or any optional element disclosed herein. While compositions and methods are described in terms of "comprising" or "including" various components or steps, the compositions and methods can also "consist essentially of" or "consist of" the various components and steps. Indeed, the present disclosure includes all alternatives, modifications, and equivalents falling within the true spirit and scope of the appended claims.

What is claimed is:

1. A method for hydraulically fracturing a plurality of wells from a pad, the method comprising:

for each of the plurality of wells, alternating, in sequence, between perforation, injection of $CO_2$, and injection of proppant-carrying fracturing fluid, while simultaneously maintaining continuous $CO_2$ injection in at least one well of the plurality of wells when perforating or injecting proppant-carrying fracturing fluid in one or more wells in the plurality of wells.

2. The method of claim 1, wherein the plurality of wells comprise a first well and a second well, and wherein alternating, in sequence, between perforation, injection of $CO_2$, and injection of proppant-carrying fracturing fluid comprises:

performing steps (a) to (l) in the listed order:

(a) perforating a first stage of the first well via a wireline;

(b) perforating a first stage of the second well via the wireline;

(c) injecting the $CO_2$ into the first stage of the first well;

(d) injecting the proppant-carrying fracturing fluid into the first stage of the first well, while simultaneously injecting the $CO_2$ into the first stage of the second well;

(e) perforating a second stage of the first well via the wireline, while the $CO_2$ is still being injected into the first stage of the second well;

(f) injecting the $CO_2$ into the second stage of the first well, while simultaneously injecting the proppant-carrying fracturing fluid into the first stage of the second well;

(g) perforating a second stage of the second well via the wireline, while the $CO_2$ is still being injected into the second stage of the first well;

(h) injecting the proppant-carrying fracturing fluid into the second stage of the first well, while simultaneously injecting the $CO_2$ into the second stage of the second well;

(i) perforating a third stage of the first well via the wireline, while the $CO_2$ is still being injected into the second stage of the second well;

(j) injecting the $CO_2$ into the third stage of the first well, while simultaneously injecting the proppant-carrying fracturing fluid into the second stage of the second well;

(k) perforating a third stage of the second well via the wireline, while the $CO_2$ is still being injected into the third stage of the first well; and (l) injecting the proppant-carrying fracturing fluid into the third stage of the first well, while simultaneously injecting the $CO_2$ into the third stage of the second well; and repeating steps (i) to (l) for subsequent stages of the first well and the second well.

3. The method of claim 1, wherein the injection of the $CO_2$ is performed during a pad phase for each stage, and wherein the injection of the proppant-carrying fracturing fluid is performed for a remainder of the zipper hydraulic fracturing of each stage.

4. The method of claim 1, wherein the $CO_2$ is injected as supercritical $CO_2$.

5. The method of claim 1, wherein the proppant-carrying fluid comprises a carrier fluid and proppant particles.

6. The method of claim 5, wherein at least a portion of the proppant particles comprise coke proppant particles.

7. The method of claim 6, wherein at least a portion of the coke proppant particles comprise microproppant coke particles.

8. The method of claim 1, wherein the $CO_2$ is injected at a pump rate in a range from 1 barrels per minute (bbl/min) to 150 bbl/min.

9. The method of claim 1, wherein the $CO_2$ is injected at a pressure in a range from 5,000 pounds per square inch (psi) to 12,000 psi.

10. The method of claim 1, wherein the $CO_2$ is injected at a temperature in a range from −60 degrees Fahrenheit (° F.) at surface to 70° F. at surface.

11. The method of claim 1, wherein an amount of $CO_2$ injected for each stage is in a range from 10 barrels (bbl) to 10,000 bbl.

12. The method of claim 1, wherein the proppant-carrying fracturing fluid is injected at a pump rate in a range from 10 barrels per minute (bbl/min) to 150 bbl/min.

13. The method of claim 1, wherein the two or more wells comprise a total of two to ten wells in the pad.

14. The method of claim 1, wherein the two or more wells comprise unconventional wells.

15. The method of claim 1, wherein at least a portion of the $CO_2$ is sourced from industrial sites.

16. A method for hydraulically fracturing a plurality of wells from a pad wherein the plurality of wells comprises a first well and a second well, the method comprising:

(i) perforating the first well;

(ii) injecting $CO_2$ in the first well while simultaneously perforating the second well;

(iii) injecting $CO_2$ in the first well while simultaneously injecting proppant-carrying fracturing fluid in the second well;

(iv) injecting $CO_2$ in the second well while simultaneously injecting proppant-carrying fracturing fluid in the first well.

17. The method of claim 16 further comprising continuously injecting $CO_2$ into the second well while simultaneously perforating a second stage of the first well.

18. The method of claim 16 further comprising maintaining continuous $CO_2$ injection in one or more wells of the plurality of wells while simultaneously perforating or injecting proppant-carrying fracturing fluid in a subsequent stage of a well of the plurality of wells.

* * * * *